US008178140B2

(12) United States Patent
Kuboi et al.

(10) Patent No.: US 8,178,140 B2
(45) Date of Patent: May 15, 2012

(54) PET POUCH/PACKAGE WITH FOLDABLE BASE

(75) Inventors: Satoshi Kuboi, Tokyo (JP); Hideki Takeuchi, Sakaki-Machi (JP)

(73) Assignees: The Coca-Cola Company, Atlanta, GA (US); Aoki Technical Laboratory, Inc. (JP)

( * ) Notice: Subject to any disclaimer, the term of this patent is extended or adjusted under 35 U.S.C. 154(b) by 1084 days.

(21) Appl. No.: 12/056,398

(22) Filed: Mar. 27, 2008

(65) Prior Publication Data

US 2009/0242503 A1 Oct. 1, 2009

(51) Int. Cl.
*B65D 81/32* (2006.01)
*B65D 35/28* (2006.01)

(52) U.S. Cl. ..... 426/115; 222/95; 222/105; 222/107; 215/900; 220/9.2; 220/666; 220/667

(58) Field of Classification Search ..... 222/105, 222/107, 92–93, 95, 386.5; 215/381, 900; 426/106, 112, 115, 117; 220/666–668, 907, 220/9.1–9.3
See application file for complete search history.

(56) References Cited

U.S. PATENT DOCUMENTS

| | | | | |
|---|---|---|---|---|
| 3,595,441 | A * | 7/1971 | Grosjean | 222/107 |
| 4,322,013 | A * | 3/1982 | Tanaka | 220/667 |
| 5,255,808 | A * | 10/1993 | Tobler | 220/6 |
| 6,733,853 | B2 * | 5/2004 | Takashima et al. | 428/35.7 |

FOREIGN PATENT DOCUMENTS

| | | | |
|---|---|---|---|
| JP | H06-006215 | U | 1/1994 |
| JP | H08-244747 | A | 9/1996 |
| JP | H10-230919 | A | 9/1998 |
| JP | H11-070929 | A | 3/1999 |
| JP | 2000-355324 | A | 12/2000 |
| JP | 2004-029970 | A | 1/2004 |
| JP | 2005170386 | A * | 6/2005 |
| JP | 2006-219157 | A | 8/2006 |

* cited by examiner

*Primary Examiner* — Drew Becker
*Assistant Examiner* — Luana Z Long
(74) *Attorney, Agent, or Firm* — Parks IP Law LLC; Collen A. Beard, Esq.

(57) ABSTRACT

A plastic bottle is provided with a mouth, a main unit, for example, a flexible, cylindrical main unit, connecting the interior of the bottle with the mouth, a base structured to close the bottom portion of the main unit and have a greater rigidity compared to the main unit. The main unit includes a lower body section extending upward from the base, a central body section extending upward from the lower body section, and a crease between the lower and central body sections. The central body section can be configured to deform into a substantially flat shape through the action of external force F so as to bend outward.

19 Claims, 15 Drawing Sheets

PET POUCH/PACKAGE WITH FOLDABLE BASE

TECHNICAL FIELD

The invention relates to plastic bottles suitable for storing and dispensing contents having a comparatively high viscosity, for example, a jelly beverage.

BACKGROUND OF THE INVENTION

Generally, container known as a spout-pouch container is suitable for containing a jelly beverage. For example, one spout pouch container has a bag-like container main unit having a flexible sheet that has a spout of rigid resin heat sealed thereto. (See Japanese Kokai Publication Hei-2004-29970.) In use, the consumer pushes the flexible sheet to squeeze out the jelly beverage from the spout. In addition, the spout pouch container has been designed so as to stand erect in cooler cases found in stores. (See Japanese Kokai Publication Hei-2006-219157.)

Also, plastic bottles, for example, PET bottles, store products having comparatively low viscosities, for example, water, tea, carbonated beverages, juices, and the like. Bottles containing those low viscous fluids have been widely marketed and have been sold at retail stores and in automatic vending machines. However, plastic bottles containing products having comparatively high viscosities such as jelly beverages, which are squeezed to be dispensed for drinking, have not been marketed.

Plastic bottles that can be folded up after use for waste recovery and plastic bottles whose volume before filling can be temporarily reduced for efficient stacking and shipping have been available. For example, a plastic bottle can be formed with soft walls and rigid walls, alternating in the circumferential direction, so that sections of the shoulder, body, and base having soft walls would fold inward after use. (See Japanese Kokai Publications Hei-8-24474 and Hei-10-230919.)

However, the base of plastic bottles readily hardens due to the molding method. For example, when producing plastic bottles using stretch blow molding, the base of the bottle becomes hard after molding because the base of the preform is stretched using a rod. When the base becomes hard, bending of the base becomes difficult or a clean fold becomes impossible even if it could be bent, and a comparatively large space remains at the bottom of the bottle. For this reason, even if a jelly beverage is packed in a bottle, it is difficult to dispense all or a substantial portion of the jelly beverage that remains at the bottom of the bottle.

Thus, there remains a need to provide a plastic bottle that allows the main unit to bend without bending of the base, thereby allowing products having a comparatively high viscosity to be removed from the base.

SUMMARY

A bottle is provided with a mouth, a main unit in fluid communication with the mouth, and a base. The base forms the bottom of the main unit, supports the bottle in an upright position, and exhibits a rigidity greater than the rigidity of the main unit. The mouth, main unit, and base can define a retention space with a central axis useful for storing a product such as a food or beverage product.

The main unit can be a flexible, cylindrical main unit. The main unit may include a lower body section, a central body section, and a crease disposed between the lower body section and the central body section. The lower body section extends upward from the base and the central body section extends upward from the lower body section. In addition, the central body section is configured to bend outward to a deformation state when an external force is applied. The deformation state includes a substantially flat shape.

The lower body section can include a pair of first sections and a pair of second sections. The pair of first sections is configured to position the central body section in the same plane as the base when in the deformation state. The pair of second sections can be disposed between the pair of first sections and is configured to position the central body section in an overlapping position with the base and the pair of first sections.

Another aspect disclosed herein relates to a plastic bottle provided with a mouth, a main unit in fluid communication with the mouth, and a base forming a bottom of the main unit and configured to support the bottle to stand upright and having a rigidity greater than the rigidity of said main unit.

The main unit can be a flexible, cylindrical main unit. The main unit can include a lower body section that extends upward from the base, a central body section that extends upward from the lower body section, and a crease between the lower body section and the central body section. The central body section deforms into a deformation state of a substantially flat shape when an external force is applied and the central body section bends outward. The central body section extends upward and downward in the deformation state and when viewed from the lower body section, roughly approximates an inverted T shape. The crease can be positioned on a line at the intersection in the roughly inverted T shape.

It is to be understood that both the foregoing general description and the following detailed description are exemplary and explanatory only and are not restrictive of the invention, as claimed.

DESCRIPTION OF THE EMBODIMENTS

Figure 1:
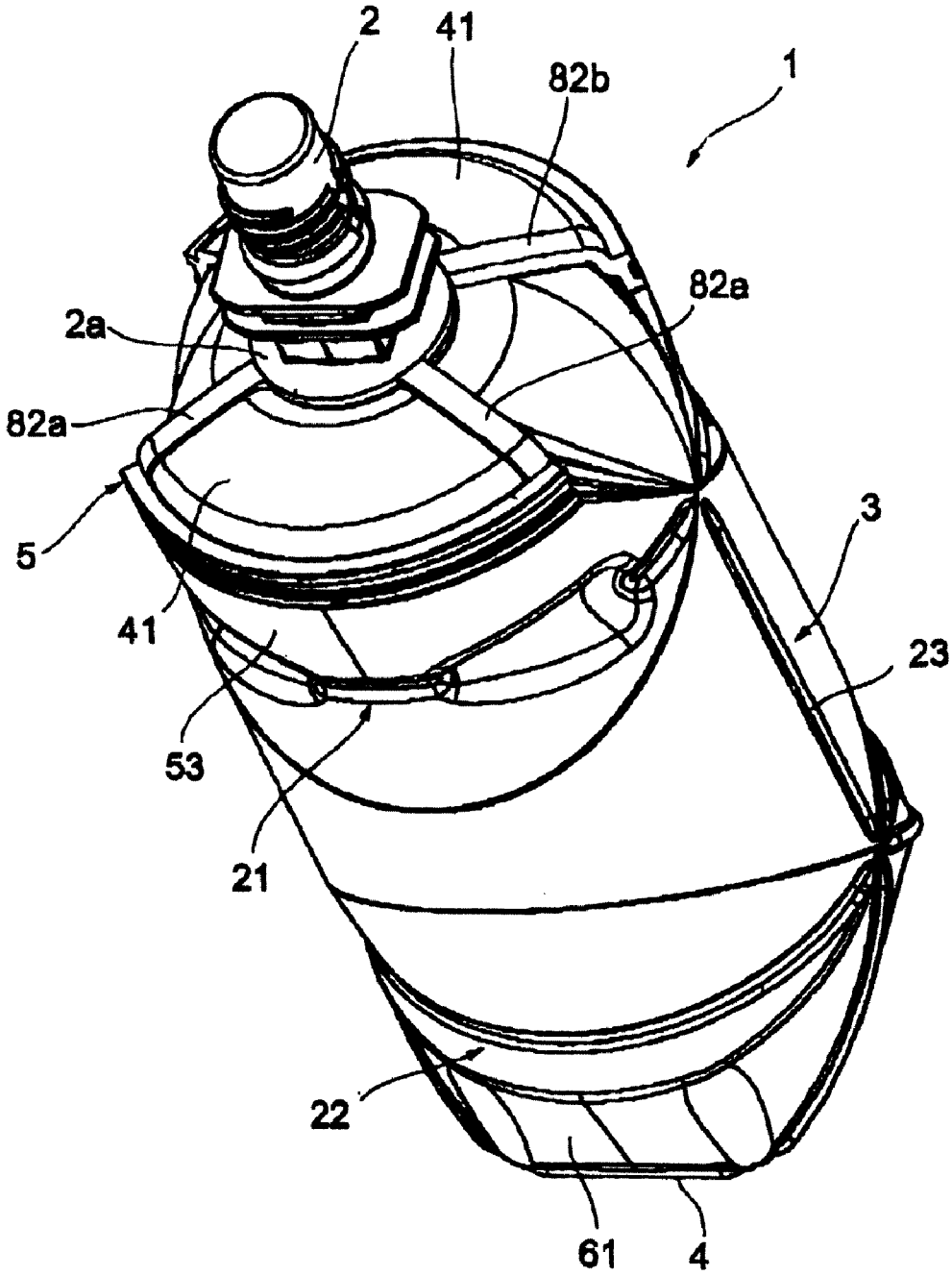
FIG. 1 depicts a perspective view of a plastic bottle according to one embodiment of the invention disclosed herein.

Disclosed herein are plastic bottles suitable for storing and dispensing products, including viscous food or beverage products.

In an embodiment disclosed herein, a plastic bottle includes a mouth, a main unit in fluid communication with the mouth, and a base to form the bottom of the main unit, configured to support the bottle in an upright position and having a rigidity greater than the rigidity of the main unit. The mouth, main unit and base define a retention space suitable for storing products, such as viscous beverage and food products.

In one embodiment, the plastic bottle is manufactured from a thermoplastic resin using various molding techniques. Suitable resins include at least one of polyethylene terephthalate (PET), polyethylene, and polypropylene. Prior to molding, the resin can be strengthened by biaxial stretching.

The mouth, main unit, and base can be integrally molded from a resin. Suitable molding techniques include blow molding, injection blow molding, and two-axis stretch blow molding. For example, when the plastic bottle is formed using the injection stretch blow molding technique, the molding steps include injection molding of a preform into a predetermined shape, and stretching of the preform in the longitudinal direction by a stretching rod and in the transverse direction by air blowing.

Following molding and/or before filling the plastic bottle with a product, the plastic bottle can be washed and/or sterilized, for example, by heated water or chlorine sterilization techniques. After the plastic bottle is filled with the product, the mouth may be closed. In one embodiment, the mouth and a cap are sealed, providing a bottle in a sealed state. In one embodiment, the rigid portion is configured to allow the bottle to be pressed in a downward direction such that the cap opens.

The retention space defined by the main unit, mouth, and base can contain a comparatively high viscous product. Exemplary products for use with the plastic bottles disclosed herein include, without limitation, jelly beverages, liquid foods, miso, mayonnaise, and jams. Use of the plastic bottles disclosed herein is not restricted to comparatively high viscous products, however. The plastic bottles can alternatively contain comparatively low viscous products, for example, water, tea, fruit juices, alcohol, energy drinks, or carbonated beverages.

A consumer, food service provider, or machine may dispense the product from the plastic bottle by applying a transverse force, for example, squeezing, to the main unit. Depending on the amount of force applied, at least a portion of the product can be expelled through the mouth. Generally, a sufficient amount of force is slightly more than the force a consumer uses to hold a bottle in one hand. Specifically, the central body section of the main unit deforms to a flat or substantially flat shape by the application of force. Consequently, the product contained therein, even if exhibiting a comparatively high viscosity, can be expelled through the mouth.

In an embodiment, the main unit is a flexible, cylindrical shaped unit. The main unit can include a lower body section extending upward from the base, a central body section extending upward from the lower body section, and a crease disposed between the lower body section and the central body section. The central body section can deform to a deformation state by the application of an external force. The application of force bends the central body section outward to a substantially flat shape.

In an embodiment, the crease may have a concave shape in the main unit. In a further embodiment, the crease extends at least a portion of the circumference of the main unit. In another embodiment, the crease extends about the entire circumference of the main unit.

In an embodiment, the lower body section can include a first section positioned on the same plane as the base when the central body section is in a deformation state and a second section overlapping the first section, thereby deforming the bottle from a steric shape to a planar shape. Consequently, the portion of the retention space proximate to the base and the lower body section before deformation can be adequately reduced after deformation, or in an embodiment, substantially eliminated. In another embodiment, the lower body section can include a pair of first sections and a pair of second sections, the pair of second sections disposed between the pair of first sections. The pair of first sections is configured to position the central body section on the same plane as the base in the deformation state. The pair of second sections is configured such to position the central body section in a position overlapping the base and the pair of first sections in the deformation state.

Accordingly, the main unit is configured to bend without the base bending. Consequently, the product can be expelled through the mouth without collecting at the bottom of the retention space. Furthermore, the amount of product adhering to the inner wall of the central body section can be reduced relative to a bottle that deforms by inward collapse. The product at the bottom portion of the retention space can be dispensed through the mouth in part due to the bending of the main unit.

In a further embodiment, the central body section extends in the upper and lower directions in a shape roughly approximating an inverted T in a deformation state when viewed from the side relative to the lower body section and the base. A crease can be positioned on a line at the intersection of the roughly inverted T shape.

The lower body section can be configured to bend toward the central body section via the crease so as to be integral with the base when the central body section is in the deformation state. In another embodiment, the lower body section is configured to bend toward the central body section via creases, thereby overlapping the central body section. In an embodiment, the lower body section bends toward a side of the central body section.

The transverse cross-sectional shape of the lower body section and the planar shape of the base, respectively, can adopt symmetrical shapes and may be configured to satisfy (a) to (c):

(a) arc BHD=curve BGD (b) curve BCD=curve BFD>curve BGD (c) straight line CH=straight line CG Point B and point D are positioned mutually facing and enclosing the central axis of an embodiment of a plastic bottle on the crease, point H is positioned at the most distant position from point B and point D on the crease, point G is the intersection point of the base and the central axis, point C and point F are positioned at the most distant position from point G on a line that intersects the base and the plane containing point H and point G. By adopting such a geometric shape, the lower body section can be bent without bending the base.

The transverse cross-sectional shape of the central body section can approximate a symmetrical shape and be configured to satisfy (d):

(d) arc AE=arc BHD

Point A and point E lie on the central body section and are positioned to mutually face and enclose the central axis on a plane that includes point B and point D.

In one embodiment in the deformation state, the width of the central body section, the width of the lower body section, and the width of the base can be substantially the same width.

In an embodiment, the central body section and the lower body section can be individually deformed when the boundary between the central body section and the lower body section is distinct. In a further embodiment, the central body section includes two parallel edges in the upper and lower directions in the deformation state, and the crease can extend in the circumferential direction of the main unit such that the sections on the extension line of the two edges are discontinuous. The discontinuous sections can bend outward when the continuous sections of the crease are on the interior of the main unit, thereby inducing deformation.

In a further embodiment, the crease can have one or more steps positioned outside of the discontinuous sections. When external force is applied to the crease, the crease bends such that the steps form an apex, and when further external force is applied during that state, the discontinuous sections bend outward. Therefore, when the crease is bent in stages, the main unit is deformed more readily in comparison to a bottle without steps.

In a further embodiment, at least two pairs of steps can form proximate to the discontinuous sections of the crease. The central body section can have a pair of second creases that mutually face and enclose the central axis of the plastic bottle, and the pair of second creases positioned on two parallel edges in the upper and lower directions in a flat shape. The central body section can readily deform into the deformation stage since the region for the two edges having a substantially flat shape is preformed in the central body section. The second creases can be formed in convex shape in the central body section. Bending outward from the second crease in the central body section is facilitated during deformation to a substantially flat shape.

The main unit can include an upper body section extending upward from the central body section, a tapered shoulder connecting the upper body section with the mouth, and a third crease between the upper body section and the central body section. The crease and the third crease are positioned on two edges above and below when the central body section is in the deformation state. In an embodiment, at least a portion of the inner wall of the upper body section can contact at least a portion of the inner wall of the shoulder. In such a structure, the entire main unit can bend into a shape generally resembling an I-beam shape when viewed from a side.

In an embodiment, the upper body section and the shoulder take shapes to release the length that changes during deformation. In such a structure, no strain develops on the shoulder and upper body section following deformation.

In another embodiment, the upper body section is configured to bend toward the side of the central body section via the third crease and becomes integral with the shoulder. In a further embodiment, the third crease can form a concave shape in the main unit.

Another aspect disclosed herein relates to a plastic bottle provided with a mouth, a main unit in fluid communication with the mouth, and a base forming a bottom of the main unit and configured to support the bottle to stand upright and having a rigidity greater than the rigidity of said main unit.

The main unit can be a flexible, cylindrical main unit. The main unit can include a lower body section that extends upward from the base, a central body section that extends upward from the lower body section, and a crease between the lower body section and the central body section. The central body section deforms into a deformation state of a substantially flat shape when an external force is applied and the central body section bends outward. The central body section extends upward and downward in the deformation state and when viewed from the lower body section, roughly approximates an inverted T shape. The crease can be positioned on a line at the intersection in the roughly inverted T shape.

Figure 3:
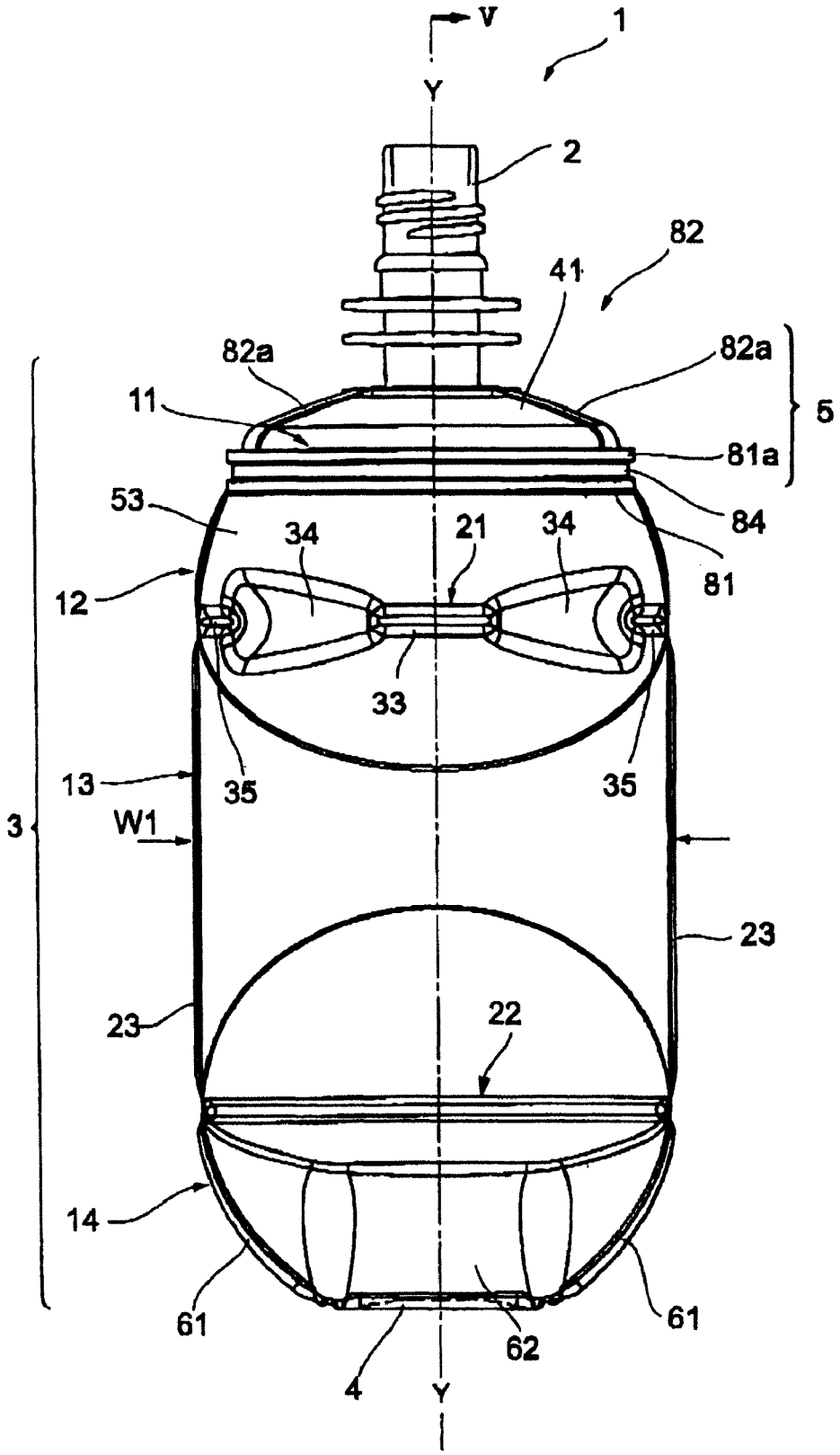
FIG. 3 depicts a front view of the plastic bottle of FIG. 1.
Figure 4:
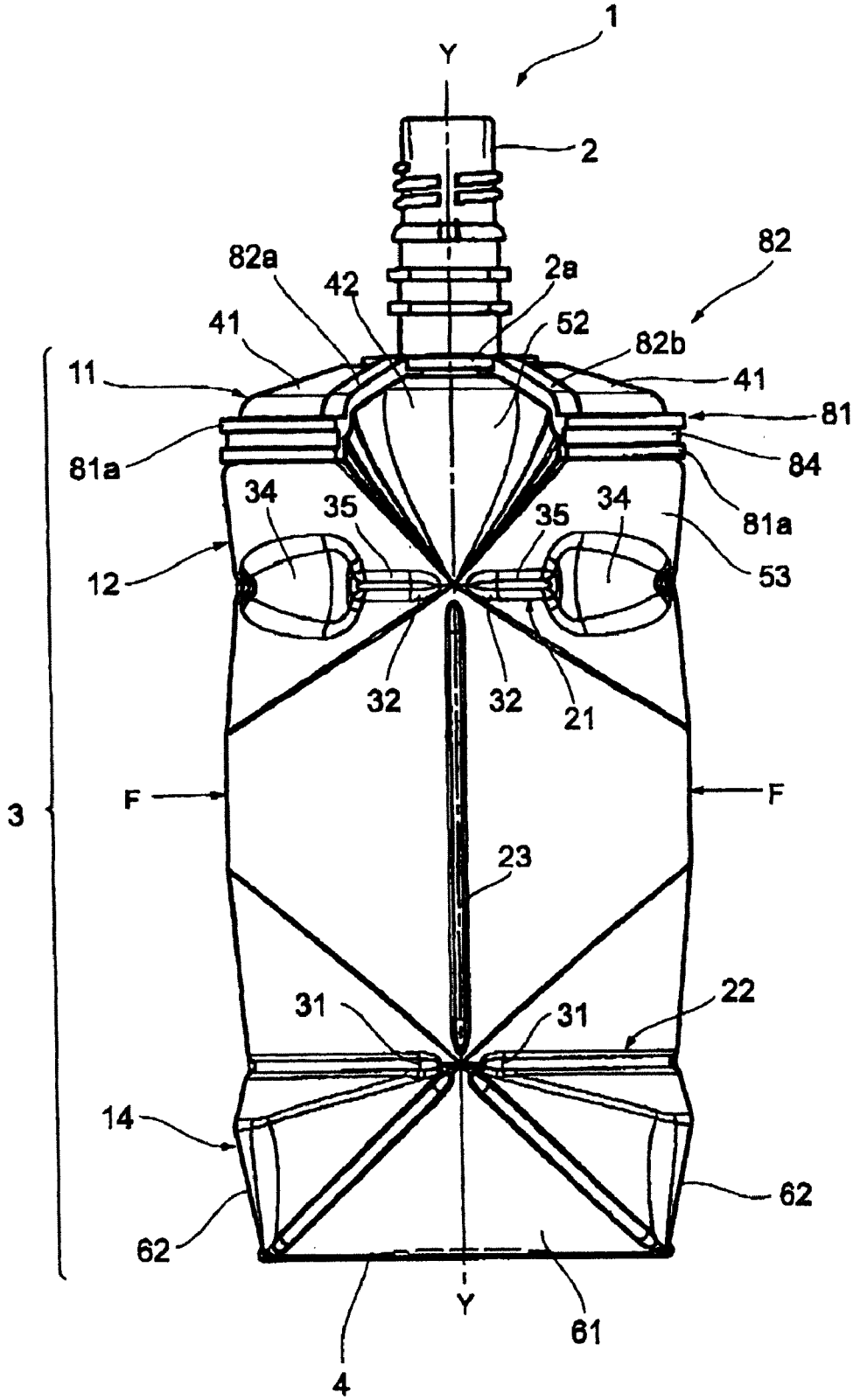
FIG. 4 depicts a side view from the transverse direction, shifted 90 degrees, of the plastic bottle of FIG. 1.

Reference will now be made in detail to various, exemplary embodiments illustrated in the accompanying drawings. Wherever possible, the same reference numbers will be used throughout the drawings to refer to the same or like parts. Terms used in the specification are defined as follows:

Terms that indicate direction, such as "upper" and "lower", are used when a plastic bottle 1 is set upright on a horizontal plane, the plane depicted in FIGS. 3 and 4. Accordingly, the interior of the paper plane in FIG. 3 is "up" and the foreground is "down". The upward/downward directions refer to the direction of Y-Y central axis of bottle 1. The transverse direction refers to the direction at right angles to the Y-Y central axis. Traverse strength refers to the strength relative to a load in the transverse direction. Height refers the length along the direction of the Y-Y central axis. Transverse cross-sectional shape refers the cross-sectional shape of bottle 1 on a plane at right angles to the Y-Y central axis. Circumferential direction refers to the direction along the contour of the transverse cross-sectional shape.

Figure 2:
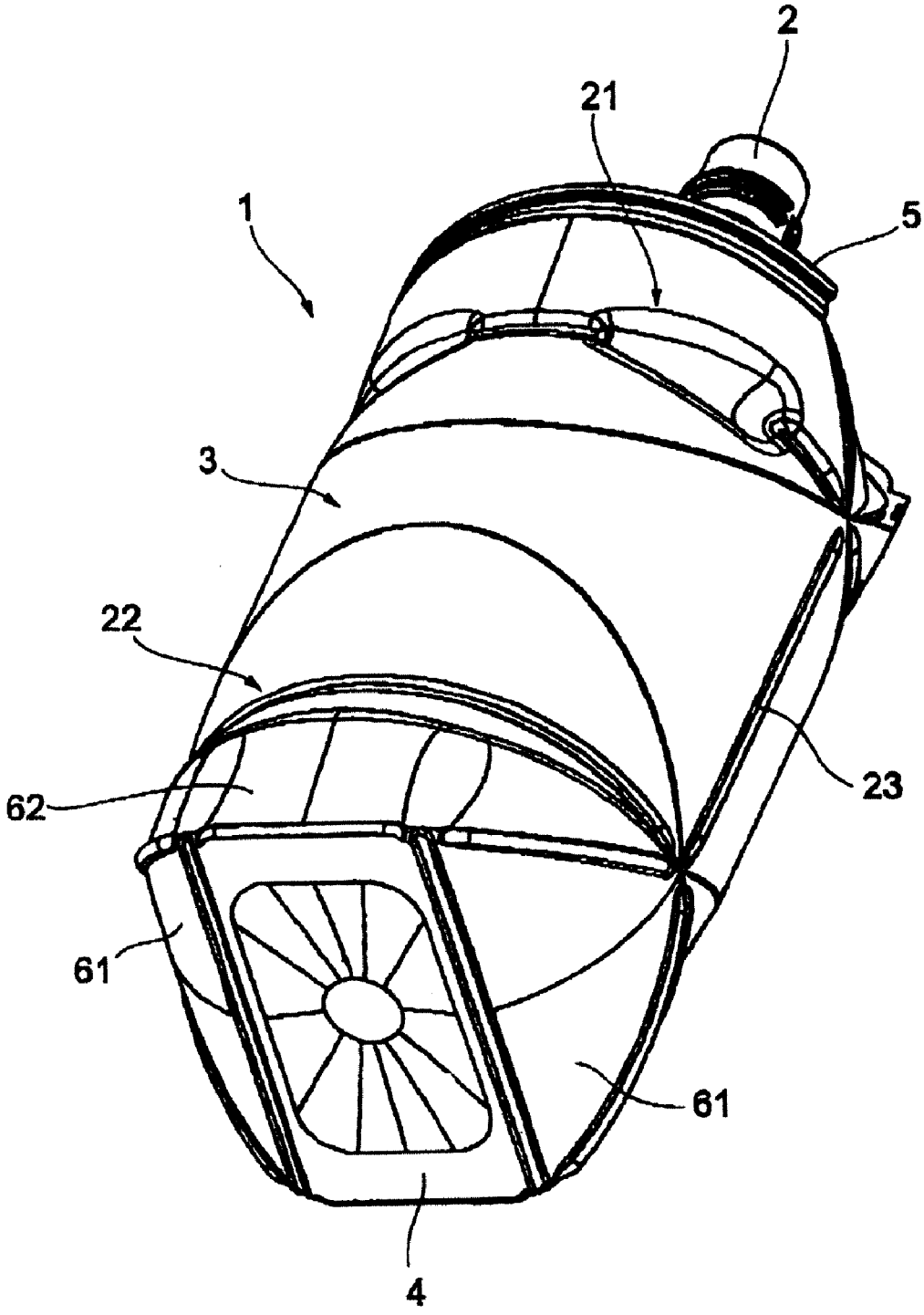
FIG. 2 depicts another perspective view of the plastic bottle of FIG. 1.

FIGS. 1 and 2 depict perspective views of a plastic bottle 1. Bottle 1 includes a mouth 2, a main unit 3, a base 4 forming a bottom of main unit 3, and a rigid portion 5 positioned above and outside of main unit 3. Mouth 2, main unit 3, base 4, and rigid portion 5 are molded integrally from the same resin. Mouth 2, main unit 3, and base 4 define a retention space that retains a product therein. Conversely, rigid portion 5 is exterior to the retention space, although continuous with lower edge 2*a* and main unit 3, as shown in FIG. 5, and does not directly contact the product therein.

Figure 5:
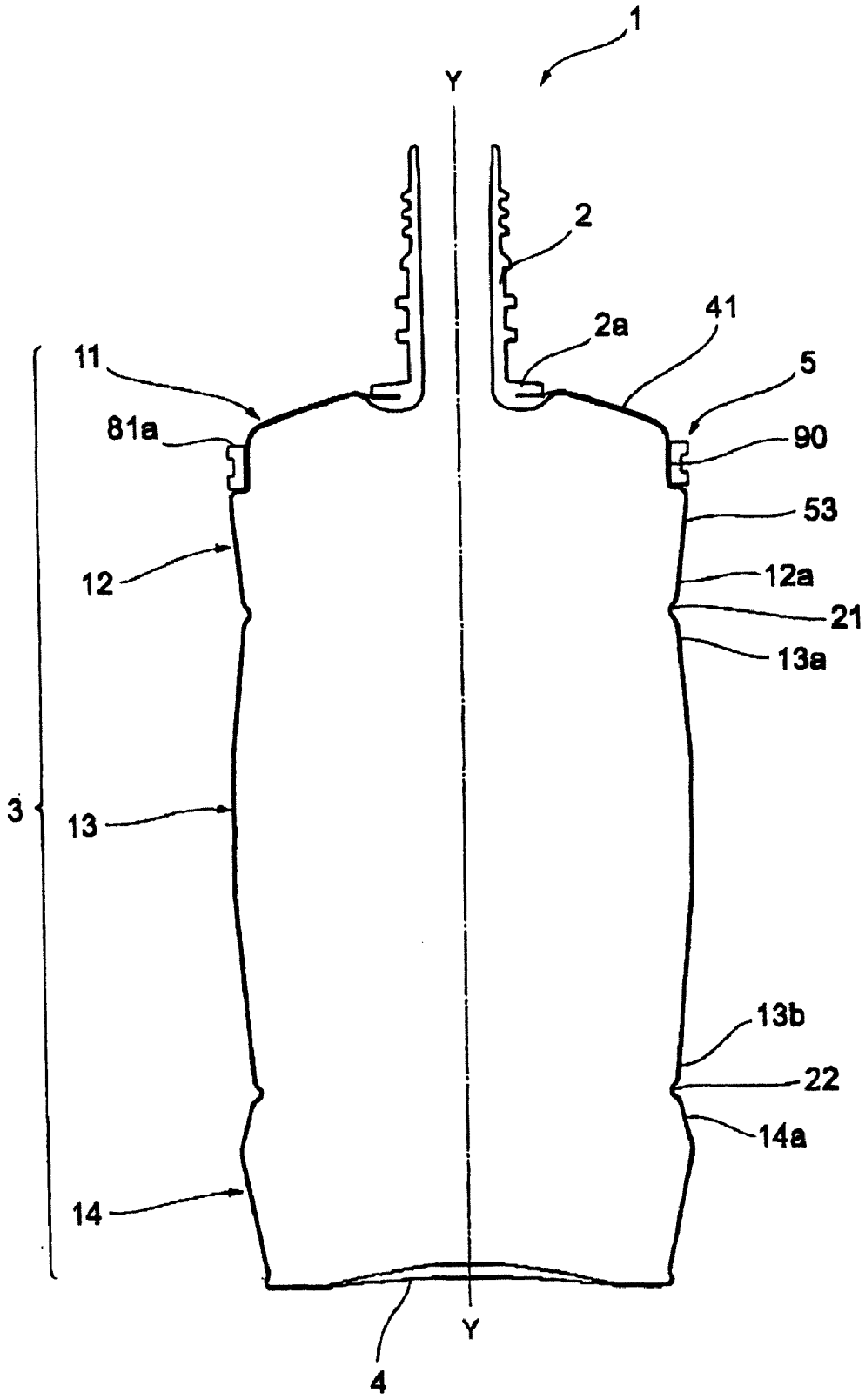
FIG. 5 depicts a longitudinal cross-sectional view cut along line V-V of the plastic bottle of FIG. 3.

Referring to FIG. 5, the thickness of the resin forming main unit 3 is less than the thickness of mouth 2 and rigid portion 5. While using the same resin, shape retention, hardness and strength are imparted to mouth 2 and rigid portion 5 while flexibility is imparted to main unit 3 by altering the thickness of the resin of each portion. The thickness of base 4 is about equal to that of main unit 3, but the rigidity is greater than that of main unit 3. Injection stretch blow molding can increase the hardness of base 4, relative to the hardness of mouth 2, main unit 3, and rigid portion 5.

Mouth 2 opens at the upper edge to function as an outgoing port for a product. The aperture of mouth 2 is opened and closed by a threaded cap. (Not shown.) Lower edge 2*a* of mouth 2 is molded in ring shape of predetermined thickness.

Figure 7:
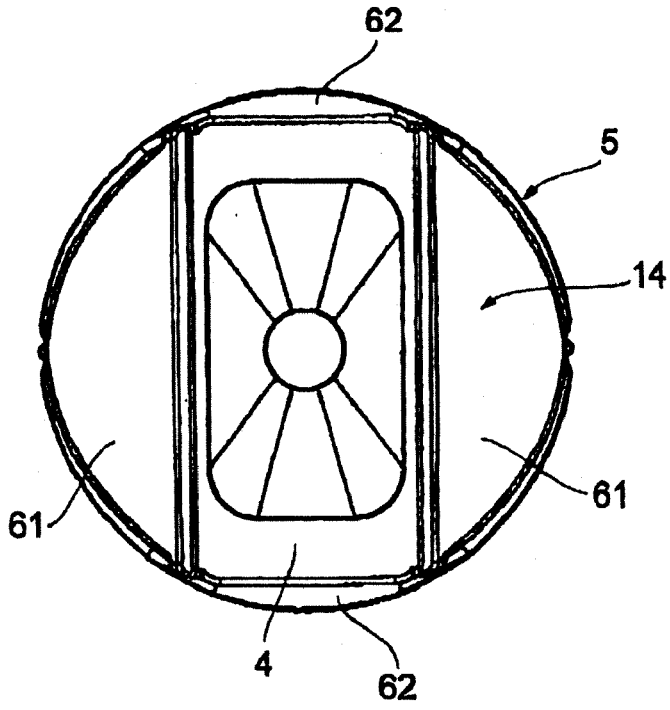
FIG. 7 depicts a bottom view of the plastic bottle of FIG. 3.

As illustrated in FIGS. 2, 5, and 7, base 4 is a flat region permitting bottle 1 to stand upright. Base 4 has a rectangular shape with axial symmetry viewed from the bottom. The center of base 4 swells slightly upward in comparison to the contour section, thereby raising the rigidity of base 4. Furthermore, the transverse cross-sectional shapes of main unit 3 and rigid portion 5 are formed with axial symmetry relative to the Y-Y central axis.

Main unit 3 is described with reference to FIG. 3-5. Main unit 3 includes a shoulder 11, an upper body section 12, a cylindrical section, or central body section 13, and a lower body section 14. Shoulder 11, upper body section 12, central body section 13 and lower body section 14 sequentially connect from the top along the Y-Y central axis. Shoulder 11 is a tapered region that is continuous with lower edge 2*a* of mouth 2 and upper body section 12. It forms an upper wall of main unit 3. Crease 21 is situated between upper body section 12 and central body section 13; crease 22 is situated between central body section 13 and lower body section 14. The regions of upper body section 12, central body section 13, and lower body section 14 are bounded by creases 21, 22. Furthermore, a pair of creases 23, 23 that extend in the upper/lower directions are formed in central body section 13.

Figure 8:
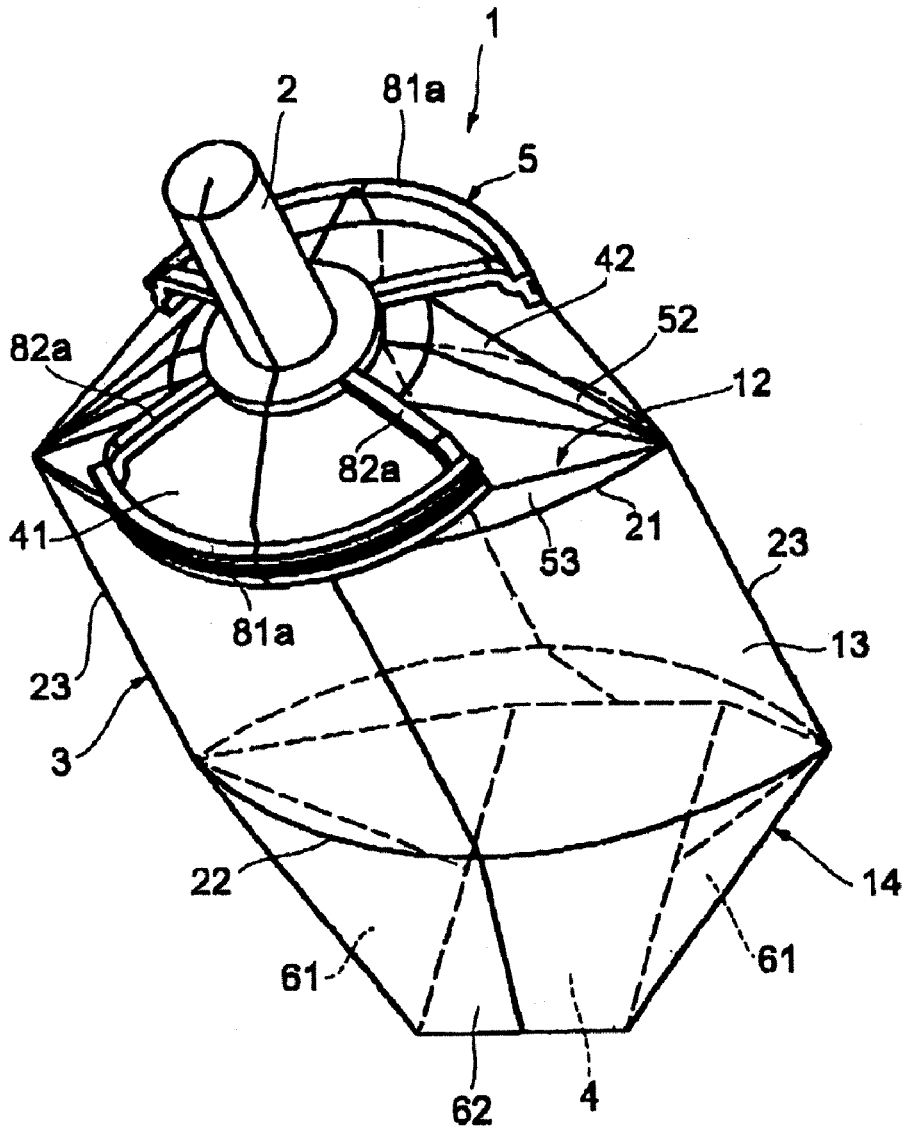
FIG. 8 depicts a perspective view of the deformation of the plastic bottle of FIG. 1 during deformation.
Figure 9:
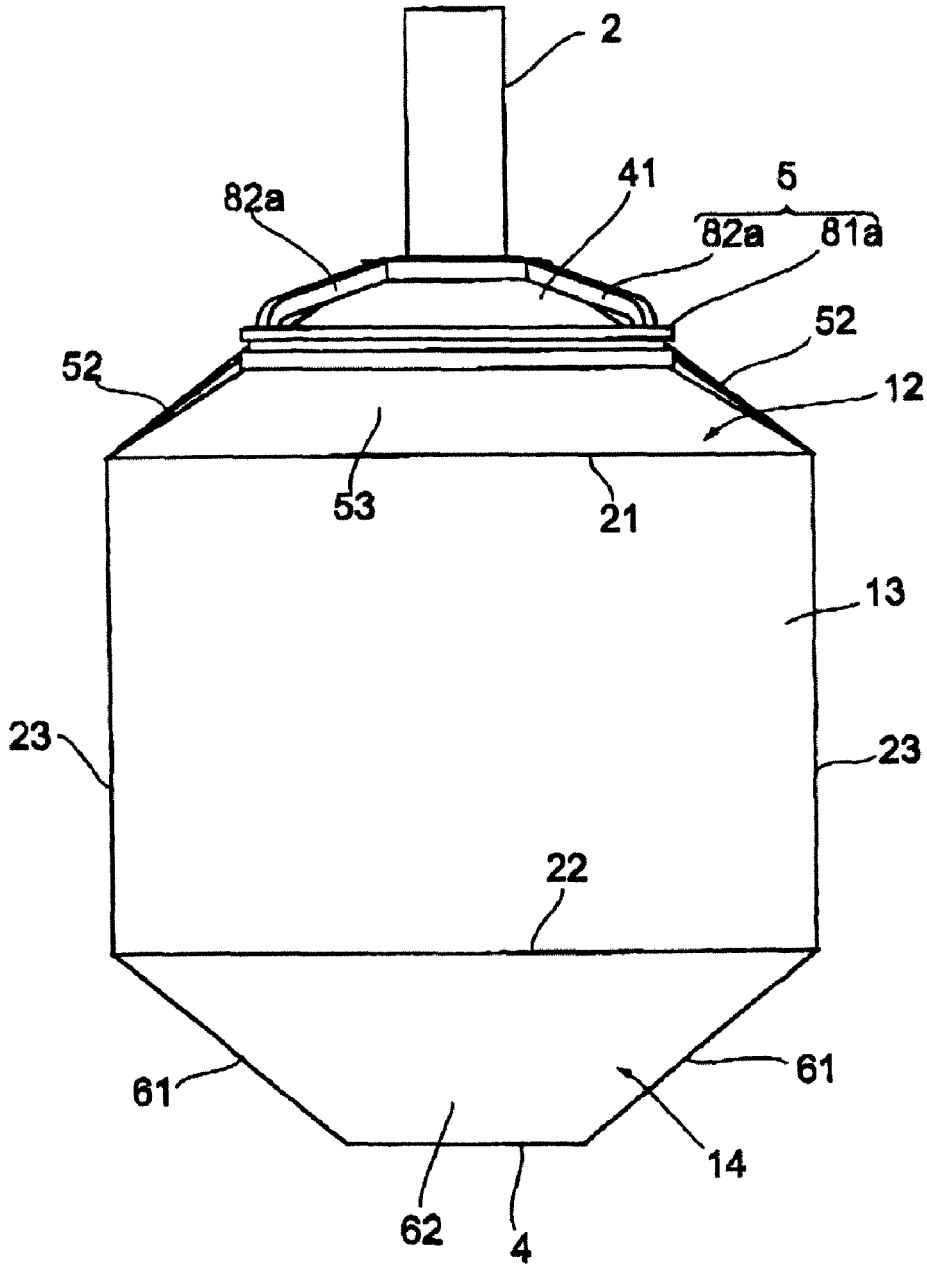
FIG. 9 depicts a front view of the plastic bottle of FIG. 8.
Figure 10:
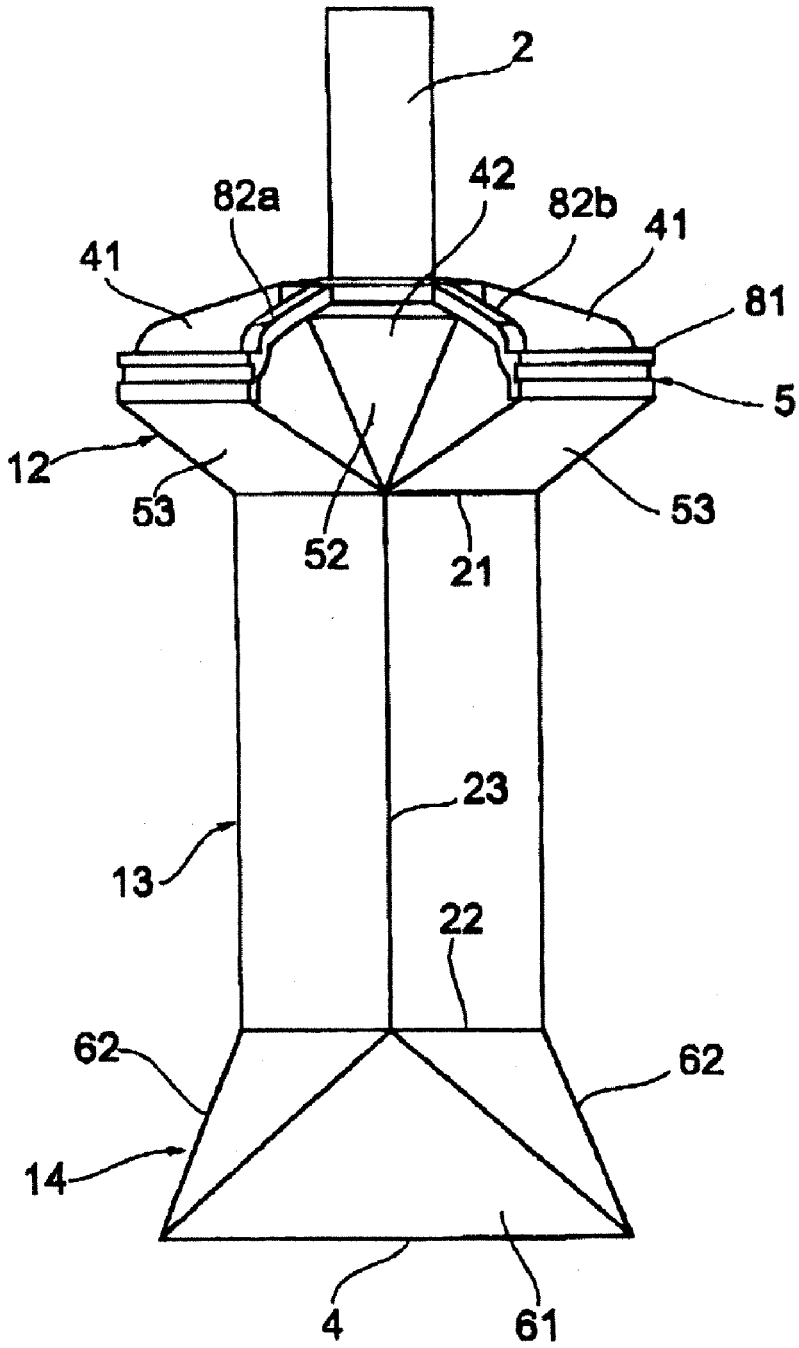
FIG. 10 depicts a side view from the transverse direction, shifted 90 degrees, of the plastic bottle of FIG. 9.
Figure 13:
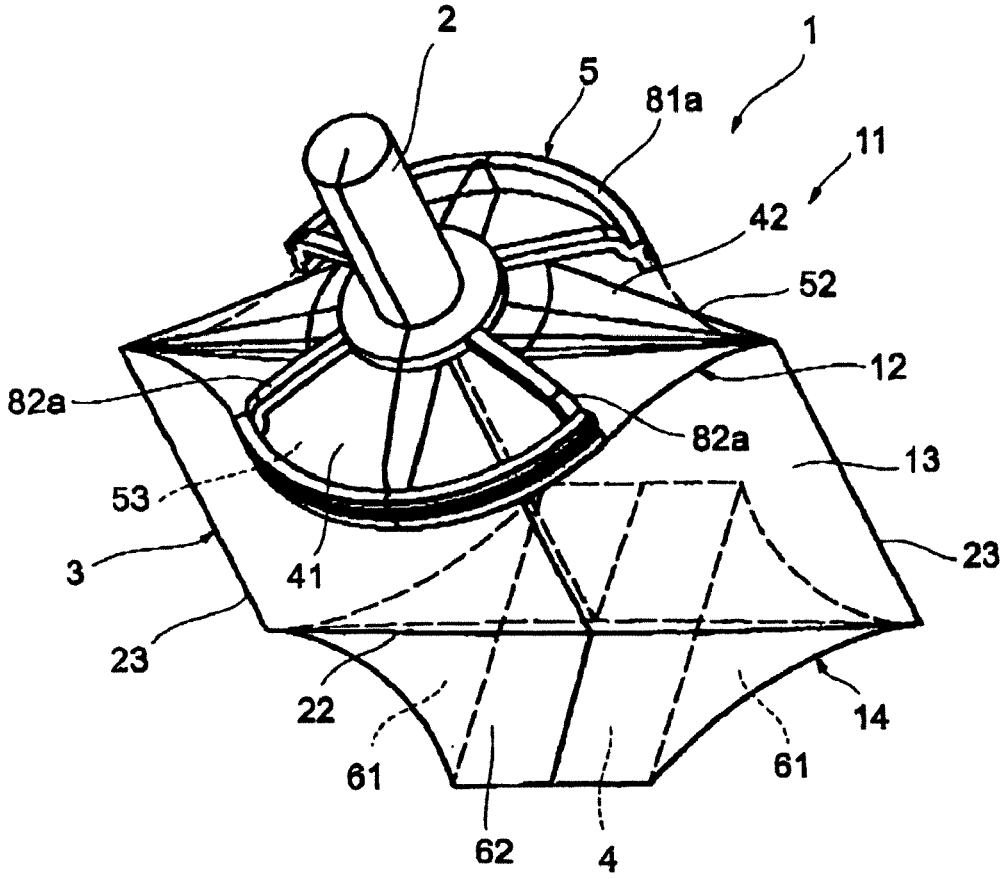
FIG. 13 depicts a perspective view of the plastic bottle of FIG. 1 after deformation.
Figure 14:
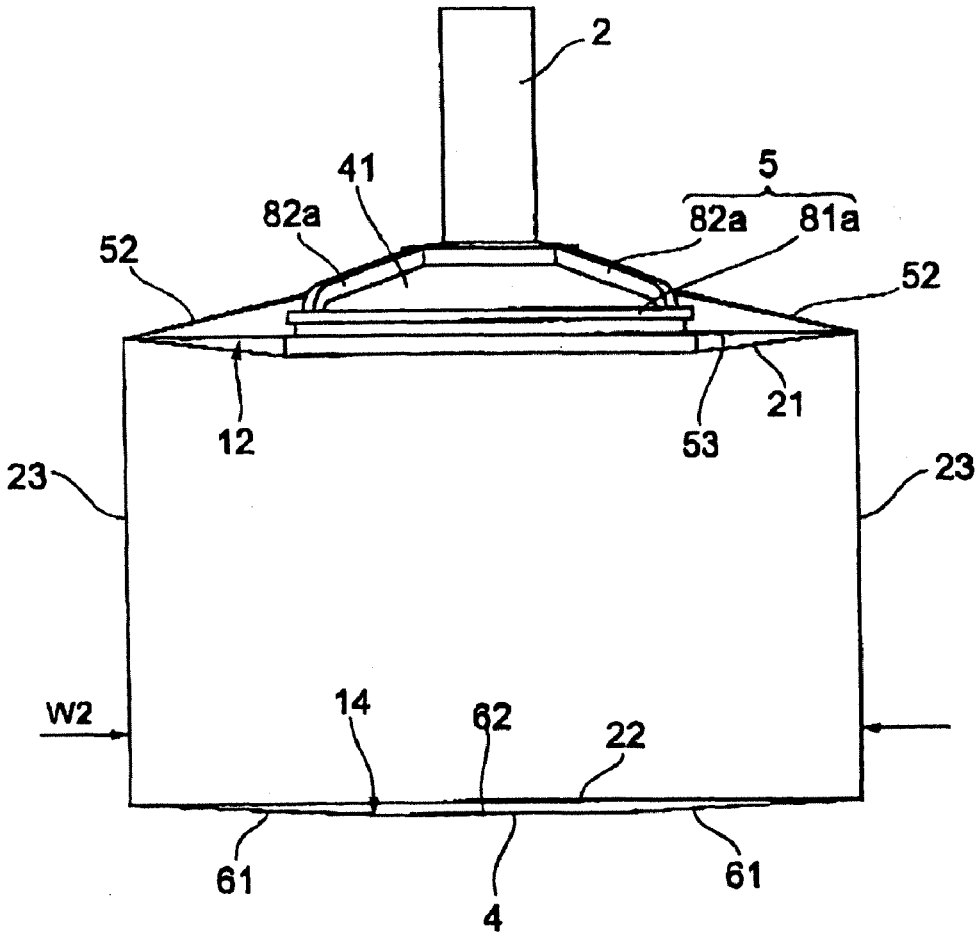
FIG. 14 depicts a front view of the plastic bottle of FIG. 13.
Figure 15:
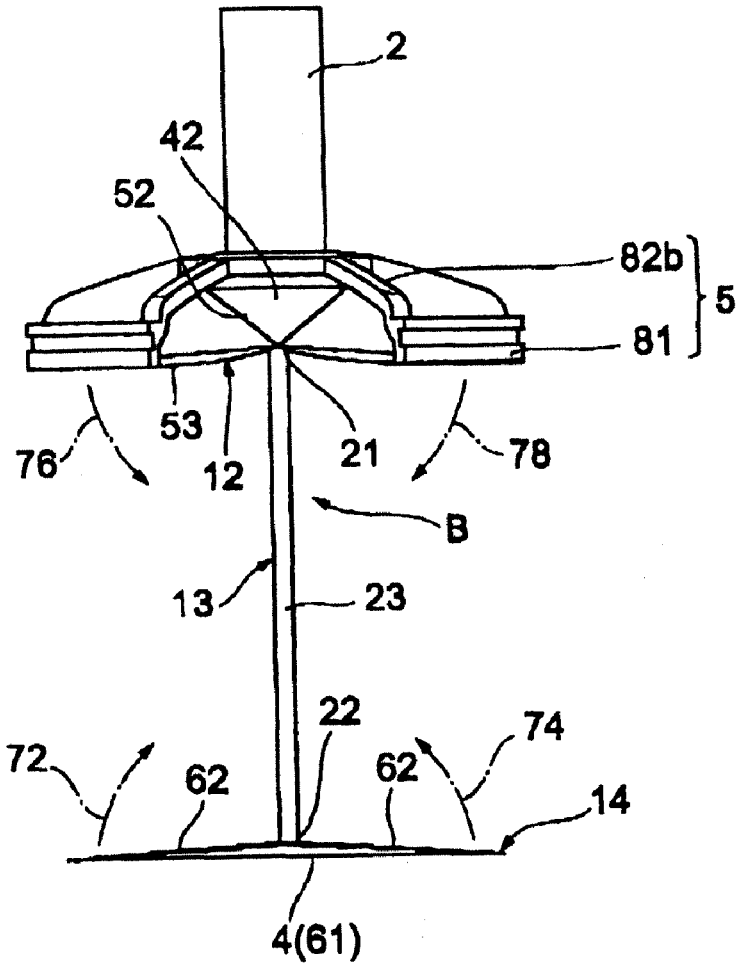
FIG. 15 depicts a side view from the transverse direction, shifted 90 degrees, of the plastic bottle of FIG. 14.
Figure 16:
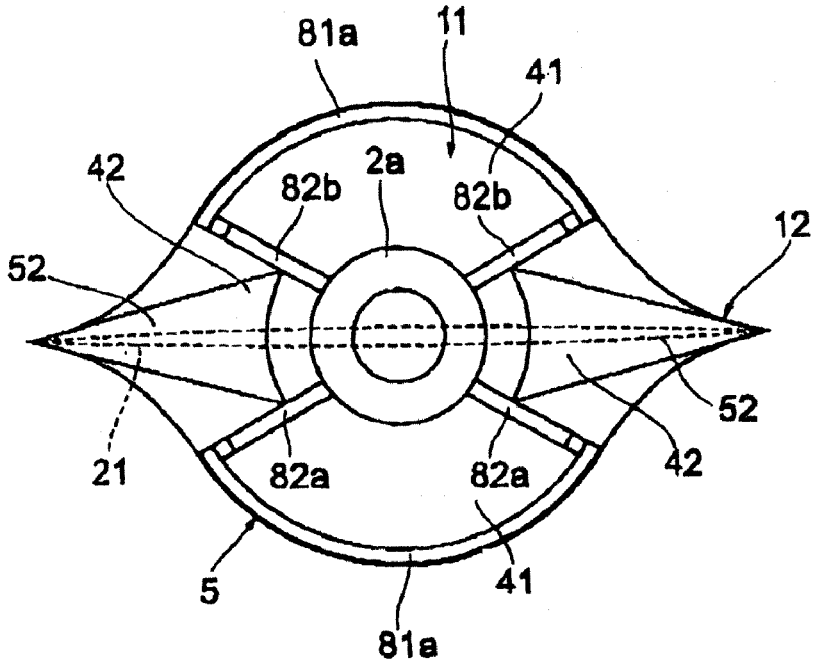
FIG. 16 depicts a top view of the plastic bottle of FIG. 14.
Figure 17:
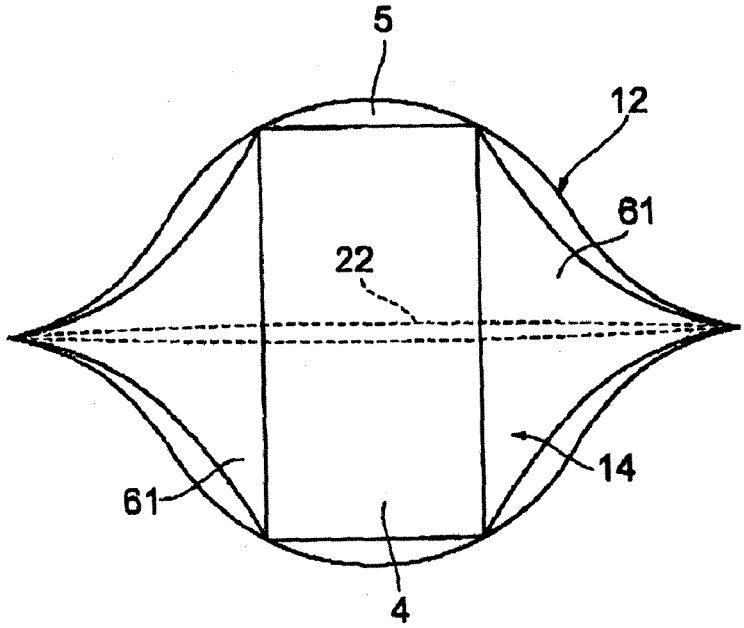
FIG. 17 depicts a bottom view of the plastic bottle of FIG. 14.

Main unit 3 is configured to deform from the state shown in FIGS. 1, 3, and 4 via the state shown in FIGS. 8-10 to the state shown in FIGS. 13-15. Central body section 13 deforms from a round cylindrical shape via an oval cylindrical shape, depicted in FIG. 8, to the substantially flat shape depicted in FIG. 15, when external force F is applied. As depicted in FIG. 4, external force F is applied to central body section 13 in a transverse direction. The two upper/lower edges of the substantially flat shape are formed via creases 21, 22, and the two left/right edges of the substantially flat shape are formed via the pair of creases 23, 23. Upper body section 12 and lower body section 14 deform so as to have substantially no height. The inner wall of upper body section 12 contacts the inner wall of shoulder 11, and the inner wall of lower body section 14 contacts the inner wall of base 4 when central body section 13 deforms into a substantially flat shape. As a result, main unit 3 undergoes volume reduction so as to present an I-beam profile overall with base 4, as shown in FIG. 15. During this series of main unit 3 deformations, rigid portion 5 does not prevent deformation of main unit 3.

Next, creases 21, 22, and 23 are described with reference to FIGS. 3-5, 14, and 15. The pair of creases 23, 23 mutually face and enclose the Y-Y central axis and extend parallel to the upward/downward directions, as shown in FIG. 3. Creases 23, 23 extend and the upper edge is directly below crease 21 while the lower edge is directly above crease 22, as shown in FIG. 4. Creases 23, 23 are formed in convex shape on the outer wall of central body section 13 and induce deformation to a substantially flat shape by outward folding from creases 23, 23. Central body section 13 is capable of deforming in a substantially flat shape until the opposing inner walls make mutual contact, as depicted in FIG. 15. Comparing FIG. 14 to FIG. 3, width W2 following deformation is wider than width W1 before deformation.

Creases 21 and 22 are formed in concave shape on the outer wall of main unit 3 and extend over roughly the entire circumference of main unit 3, as shown in FIGS. 3 and 4. However, creases 21 and 22 are discontinuous at sections above the elongation axis of creases 23, 23, as shown in FIG. 4. Thus, a total of four steps 31, two each in the vicinity of the discontinuous sections, are formed in crease 22. A total of four steps 32, two each in the vicinity of the discontinuous sections, are formed in crease 21. In another embodiment, creases 21, 22 can extend over the entire circumference of main unit 3 without any discontinuous sections. (Not shown.)

In addition, crease 21 has one traverse groove 33 with a frontal position shifted 90 degrees relative to crease 23, concave grooves 34, 34 continuous with both edges of traverse groove 33, and traverse grooves 35, 35 continuous with concave grooves 34, 34, as shown in FIG. 3. The structures of traverse groove 33, concave grooves 34, 34, and traverse grooves 35, 35 are also formed on the back side of crease 23. Concave groove 34 comprises a roughly isosceles triangle turned sideways. The apex of the isosceles triangle is continuous with one edge of traverse groove 33, and the center of the lower side of the isosceles triangle is continuous with one edge of traverse groove 35. Concave groove 34 is a deeper groove than traverse groove 33 and traverse groove 35. Consequently, steps are formed between concave groove 34 and traverse groove 33 as well as between concave groove 34 and traverse groove 35.

In this manner, steps (steps 31, 32, etc.) are attached to creases 21, 22, and the steps first bend so as to form a transverse cross-sectional shaped apex at creases 21, 22, followed by bending outward of the discontinuous section when external force F is applied. As a result, creases 21, 22 can bend in stages, and main unit 3 can more easily deform than a structure lacking steps. In an embodiment, crease 21 includes a plurality of step bends.

Furthermore, the application of external force F to the center of traverse groove 33 can form concave groove 34 having a different width and depth than traverse grooves 33 and 35. Continuous concave sections of creases 21, 22 are positioned on the surface of the side to which external force F is applied, while discontinuous sections of creases 21, 22 as well as convex creases 23, 23 are positioned on the surface of the side opposite from the surface to which external force F is applied. Central body section 13 can be induced to deform to a substantially flat shape due to the concave/convex spatial relationship.

Lower edge 12*a* of upper body section 12 and upper edge 13*a* of central body section 13 are slanted to the inside toward crease 21 in a lateral view as shown in FIG. 5. In addition, lower edge 13*b* of central body section 13 and upper edge 14*a* of lower body section 14 are slanted to the inside toward crease 22 in a lateral view. In such a structure, crease 21 and crease 22 collapse toward the inside when external force F centered on crease 21 and crease 22 is applied toward the inside. Therefore, those parts of upper body section 12, central body section 13, and lower body section 14 whose deformation to the inside is desired can be so induced. The lower edge of upper body section 12, the upper edge and lower edge of central body section 13, and the upper edge of lower body section 14 extend straight so as to smoothly link to creases 21, 22 in a front view, depicted in FIG. 3, that differs by 90 degrees from the view depicted in FIG. 5.

Figure 6:
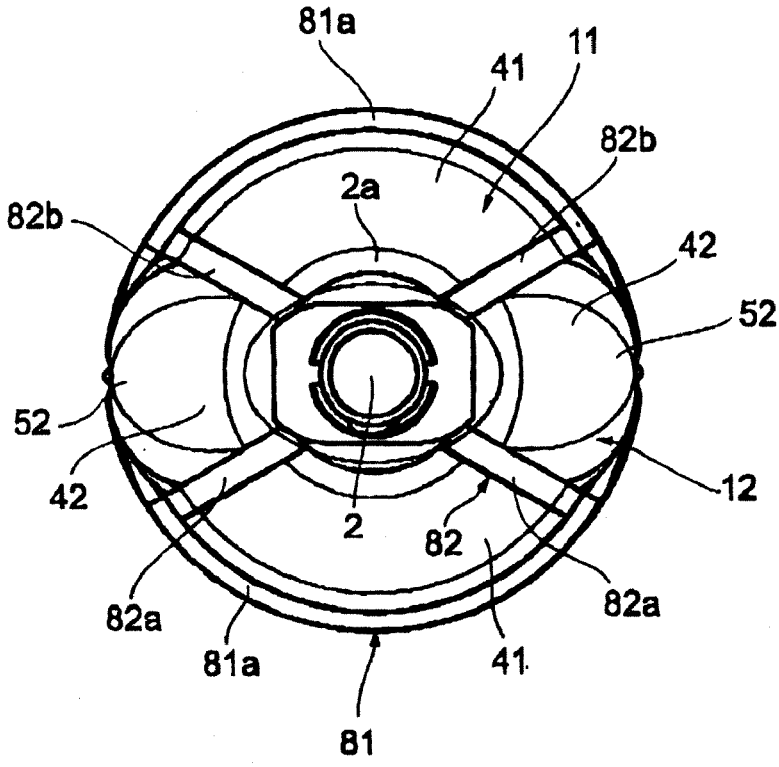
FIG. 6 depicts a top view of the plastic bottle of FIG. 3.

Next, shoulder 11 is described with reference to FIGS. 3, 4, and 6. Shoulder 11 includes a pair of fan sections 41, 41 having a fan shape in a top view, and a pair of cavities 42, 42 between a pair of fan sections 41, 41, as shown in FIGS. 3, 4, and 6. Cavity 42 is positioned lower than fan section 41. Cavity 42 is continuous with cavity 52 of up per body section 12 and is structured to form a inverted triangle in conjunction with cavity 52.

Next, upper body section 12 is described with reference to FIGS. 3, 4, 8, 11, and 13-15. Upper body section 12 includes a pair of cavities 52, 52 and a pair of flat sections 53, 53 disposed between a pair of cavities, as shown in FIGS. 3 and 4.

Figure 11:
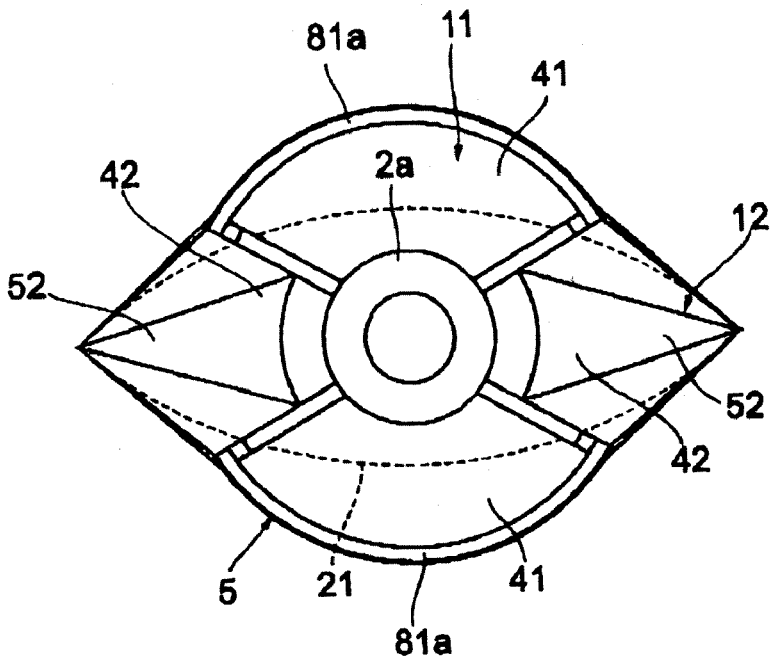
FIG. 11 depicts a top view of the plastic bottle of FIG. 9.
Figure 12:
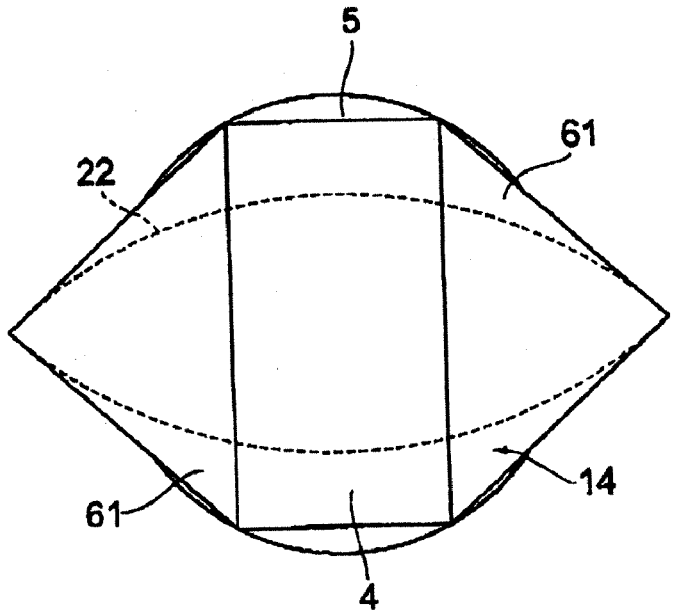
FIG. 12 depicts a bottom view of the plastic bottle of FIG. 9.

In the course of deformation of upper body section 12, flat section 53 collapses to the inside, and both edges of flat section 53 extend in the transverse direction, as shown in FIGS. 8 and 11. Furthermore, cavities 42, 52 extend in the transverse direction tracking deformation of flat section 53, their slopes become more moderate, and upper body section 12 folds. After upper body section 12 folds, a majority of flat section 53 overlaps fan section 41 from the bottom, and the inner walls of both make contact, as shown in FIGS. 13-15.

In this manner, in comparison to the pre-deformation shape, shoulder 11 and upper body section 12 extend in the transverse direction after deformation, and the extended portions are absorbed by cavity 42 and cavity 52. In other words, the extended portions (length) of shoulder 11 and upper body section 12 that changed are released since cavity 42 and cavity 52 are formed in shoulder 11 and upper body section 12. By so doing, no strain develops on shoulder 11 and upper body section 12 following deformation.

Turning now to lower body section 14, lower body section 14 is a cylindrical circumferential wall that extends between base 4 and crease 22, as shown in FIGS. 3 and 4. Lower body section 14 includes a pair of first sections 61, 61 and a pair of second sections 62, 62, as shown in FIGS. 3, 4, and 7. First section 61 and second section 62 alternately continue in the circumferential direction.

In the course of deformation of lower body section 14, the top of first sections 61, 61 open to the outside while the top of second sections 62, 62 collapse to the inside, and the height of lower body section 14 falls, as shown in FIGS. 8-10 and 12. Following deformation of lower body section 14, first sections 61, 61 are positioned on the same plane as base 4 and second sections 62, 62 overlap base 4 and first sections 61, 61 from above, as shown in FIGS. 13-15 and 17. In an explanation of this state focusing on the bottom of bottle 1, central body section 13 adopts a shape generally resembling an inverted T in a profile relative to lower body section 14 and base 4, as shown in FIG. 15. Crease 22 is positioned on a line of the intersection of two edges of this inverted T.

Following deformation as shown in FIG. 15, lower body section 14 can fold toward central body section 13 in the directions of arrows 72 or 74 centered on crease 22 in a mode integrated with base 4. Similarly, upper body section 12 can fold toward central body section 13 in the directions of arrows 76 or 78 centered on crease 21 in a mode integrated with shoulder 11. In this case, a portion, for example, up to half, of lower body section 14 can fold until it overlaps central body section 13, and a portion, for example, up to half, of upper body section 12 can fold until it overlaps central body section 13.

Next, rigid portion 5 is described in reference to FIGS. 3, 4, and 6. Rigid portion 5 is thicker than main unit 3 and its traverse strength and rigidity are greater than main unit 3. Rigid portion 5 comprises circumferential wall section 81 and connecting section 82 that connects circumferential wall section 81 with mouth 2.

Circumferential wall section 81 extends in the circumferential direction of main unit 3 so as to be discontinuous at two sections that mutually face and enclose the Y-Y central axis. In detail, circumferential wall section 81 comprises two arc sections 81*a*, 81*a*. The arc sections 81*a*, 81*a* have regions that mutually face and enclose the central axis at the most distant position from the Y-Y central axis in bottle 1. Specifically, the most distant sections of arc sections 81*a*, 81*a* from the Y-Y central axis form the greatest outer diameter of bottle 1.

Arc section 81*a* lies on the outside of the upper outer circumferential wall of main unit 3. In greater detail, it is positioned at step 90 between fan section 41 and flat section 53. The inner wall of arc section 81*a* makes planar contact with the outer wall of step 90. In addition, concave rib 84 is formed in the middle part of arc section 81*a* along the direction of extension (circumferential direction) to reinforce circumferential wall section 81.

Connecting section 82 comprises four strip shaped sections 82*a*, 82*a*, 82*b*, 82*b* that are positioned above shoulder 11. Two strip shaped sections 82*a*, 82*a* collaborate with one arc section 81*a* in cantilever support of arc section 81*a* in the planar view of FIG. 6. In detail, one edge of strip shaped sections 82*a*, 82*a* is connected to each edge of arc section 81*a* while the other edge is connected to lower edge 2*a* of mouth 2. The remaining two strip shaped sections 82*b*, 82*b* are identical in this regard.

The upper plane of strip shaped sections 82*a*, 82*a* match the upper plane of fan section 41 that is arranged between them. Similarly, the upper plane of strip shaped sections 82*b*, 82*b* matches the upper plane of fan section 41 that is arranged between them. In addition, cavity 42 between strip shaped section 82*a* and strip shaped section 82*b* faces them at a position lower than them.

In the structure of rigid portion 5, when bottle 1 is stacked horizontally in an vending machine, for example, rigid portions 5, 5 of bottles 1, 1 make mutual contact. Since rigid portion 5 has high traverse strength, as indicated above, plastic deformation would be inhibited even if a load were sustained from an adjacent bottle 1. Therefore, bottles 1 that are stacked maintain their shape. In particular, external force in the transverse direction sustained by circumferential wall section 81 could be released broadly to step 90 since circumferential wall section 81 makes planar contact with step 90. On the other hand, when main unit 3 undergoes deformation, the deformation would not be obstructed by rigid portion 5. In an embodiment, step 90 can separate from rigid portion 5 in the series of deformation steps. (Not shown.)

Figure 18:
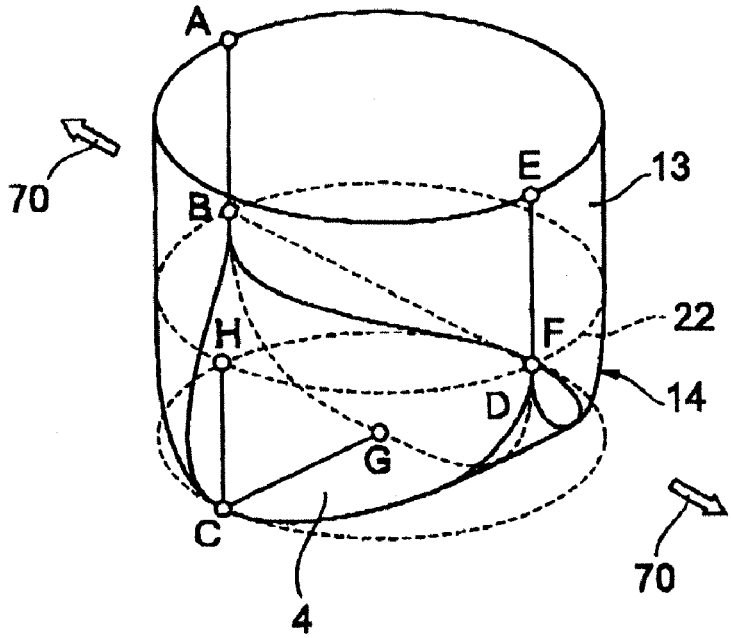
FIG. 18 depicts a schematic view of the lower portion of the plastic bottle before being folded.
Figure 19:
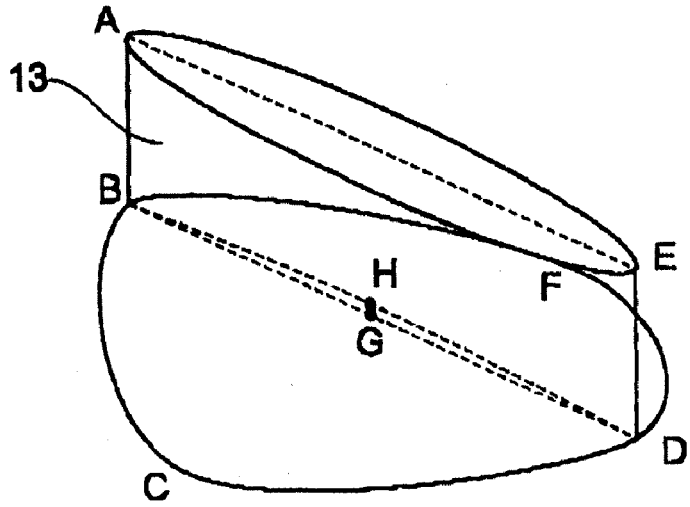
FIG. 19 depicts a schematic view of the lower portion of the plastic bottle of FIG. 18 after being folded.

Next, the folding of main unit 3 without bending base 4 is described with reference to FIGS. 18 and 19. FIGS. 18 and 19 are schematic views depicting the bottom of bottle 1. Point A and point E are positioned on central body section 13 mutually face and enclose the Y-Y central axis. Point B and point D that are positioned on crease 22 mutually face and enclose the Y-Y central axis. Finally, point A, point B, point D and point E are positioned on the same plane. Point H is positioned on crease 22 at the most distant position from point B and point D. Point G is the intersection point of base 4 and the Y-Y central axis. Point C and point F are on the line intersected by base 4 and the plane that includes point H and point G and are located at the most distant position from point G.

In such a spatial relationship, bottle 1 satisfies (a) to (c) below in the shape preceding deformation shown in FIG. 18:

(a) arc BHD=curve BGD;

(b) curve BCD=curve BFD>curve BGD; and (c) straight line CH=straight line CG.

In addition, if (d) below is satisfied in the shape preceding deformation shown in FIG. 18, the width of central body section 13 that had assumed the substantially flat shape would be about equal to the widths of lower body section 14 and base 4.

(d) arc AE=arc BHD

Arc AE becomes a straight line, as shown in FIG. 19, when point B and point D open outward as indicated by arrow 70 in the shape shown in FIG. 18. At this deformation, curve BGD is drawn upward and point G on the plane that contains point B and point D shifts so that curve BGD becomes a straight line. Furthermore, point H shifts on the straight line that links point B and point D, with the result that arc BHD becomes a straight line parallel with arc AE. It is then positioned so as to overlap straight line BGD from above. Furthermore, straight line CH becomes positioned so as to overlap straight line CG from above. Lower body section 14 can be folded without bending of base 4 since the shape based on such principles is configured in lower body section 14 and base 4.

In yet another embodiment, the shape preceding deformations disclosed herein can also be configured in upper body section 12 and shoulder 11. By so doing, upper body section 12 can be folded without bending of shoulder 11. In this case, the shape for release of the length that changes during deformation (cavity 42 and cavity 52) must be formed in upper body section 12 and shoulder 11.

When dispensed, the product can be expelled from the retention space via mouth 2 by flattening main unit 3. In particular, creases 21, 22, 23 and sections of main unit 3 connected thereto are configured to induce deformation. Moreover, main unit 3 can be folded even without folding base 4, thereby enabling substantially the entire retention space of main unit 3 to be emptied. Thus, product located proximate to upper body section 12 and shoulder 11 and proximate to lower body section 14 and base 4 can be dispensed through mouth 2 by bending upper body section 12 and lower body section 14, as denoted by arrows 72, 74, 76, and 78 in FIG. 15.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A plastic bottle for dispensing a jelly beverage comprising:

a mouth, a flexible cylindrical main unit in fluid communication with said mouth;

a base forming a bottom of said main unit and configured to support the bottle to stand upright and having a rigidity greater than the rigidity of said main unit, said main unit comprising:

a lower body section extending upward from said base, a central body section extending upward from said lower body section and configured to bend outward to a deformation state comprising a substantially flat shape when an external force is applied, and a crease disposed between said lower body section and said central body section, the central body section Including a pair of second creases that mutually face and enclose a central axis, an upper body section that extends upward from said central body section, a tapered shoulder connecting said upper body section with said mouth, and a third crease disposed between said upper body section and said central body section, the third crease having at least one traverse groove and at least one concave groove continuous with an edge of the at least one traverse groove, the at least one concave groove being deeper than the at least one traverse groove, wherein said crease and said third crease are configured to be positioned on two edges above and below and an inner wall of said upper body section is configured to contact an inner wall of said shoulder when said central body section is in the deformation state; and said lower body section comprising a pair of first sections configured to position said central body section, in the deformation state, in the same plane as said base, and a pair of second sections disposed between said pair of first sections and configured to position said central body section, in the deformation state, in a location overlapping said base and the pair of first sections.

2. The plastic bottle according to claim 1, wherein said central body section, in the deformation state, is configured to extend upward and downward into a roughly inverted T shape viewed from the side relative to said lower body section and said base, and said crease is positioned on a line at the intersection in the roughly inverted T shape.

3. The plastic bottle according to claim 1, wherein said lower body section is configured to fold toward the side of said central body section via said crease and to be integral with said base when said central body section is in the deformation state.

4. The plastic bottle according to claim 3, wherein said lower body section is configured to bend toward the side of said central body section via said crease and to overlap said central body section.

5. The plastic bottle according to claim 1, wherein the transverse cross-sectional shape of said lower body section and the planar shape of said base are symmetric and configured to satisfy (a), (b), and (c):

(a) arc BHD=curve BGD;

(b) curve BCD=curve BFD>curve BGD; and (c) straight line CH=straight line CG;

wherein point B and point D are positioned mutually facing and enclosing a central axis of the plastic bottle on said crease, point H is positioned at the most distant position from point B and point D on said crease, point G is the intersection point of said base and said central axis, point C and point F are positioned at the most distant position from point G on a line that intersects said base and the plane containing point H and point G.

6. The plastic bottle according to claim 5, wherein the transverse cross- sectional shape of said central body section is a symmetrical shape and configured to satisfy (d):

(d) arc AE=arc BHD;

wherein point A and point E lie on said central body section and are positioned so as to mutually face and enclose said central axis on a plane that includes point Band point D.

7. The plastic bottle according to claim 1, wherein said crease is concavely shape.

8. The plastic bottle according to claim 7, wherein said crease extends across the complete or substantially complete circumference of said main unit.

9. (Previously pending) The plastic bottle according to claim 7, wherein said central body section, in the deformation state, has two parallel edges in the upper and lower directions and said crease extends in the circumferential direction of said main unit so that there are discontinuous sections on an extension line of said two parallel edges.

10. The plastic bottle according to claim 9, wherein said crease has steps positioned outside of the discontinuous sections.

11. The plastic bottle according to claim 10, wherein at least two pair of said steps form proximate the discontinuous sections of said crease.

12. (Previously pending) The plastic bottle according to claim 1, wherein said pair of second creases, in the deformation state, is positioned on two parallel edges in the upper and lower directions.

13. The plastic bottle according to claim 12, wherein the second creases are convexly shaped.

14. The plastic bottle according to claim 1, wherein said upper body section and said shoulder have a shape to release tRe g length that changes during deformation.

15. The plastic bottle according to claim 14, wherein said upper body section is configured to bend together with said shoulder in a direction of said central body section via said third crease.

16. The plastic bottle according to claim 1, wherein said third crease is concavely shaped.

17. The plastic bottle according to claim 1, wherein said mouth, said main unit, and said base are injection stretch blow molded.

18. The plastic bottle according to claim 1, further comprising a jelly beverage contained within the main unit.

19. A plastic bottle comprising:

a mouth, a flexible cylindrical main unit in fluid communication with said mouth;

a base forming a bottom of said main unit and configured to support the bottle to stand upright and having a rigidity greater than the rigidity of said main unit, a rigid portion thicker than the main unit and positioned above and outside the main unit. the rigid portion having a circumferential wall section and a connecting section that connects the circumferential wall section with said mouth;

the circumferential wall section having at least one arc section forming the greatest outer diameter of the plastic bottle; and the connection section having at least two strip shaped Sections, each strip section connected to the at least one arc section at one end and to a lower edge of said mouth at another end;

said main unit comprising:

a lower body section extending upward from said base, a central body section extending upward from said lower body section and configured to bend outward to a deformation state comprising a substantially flat shape when an external force is applied, and a crease disposed between said lower body section and said central body section, and said lower body section comprising a pair of first sections configured to position said central body section, in the deformation state, in the same plane as said base, and a pair of second sections disposed between said pair of first sections and configured to position said central body section, in the deformation state, in a location overlapping said base and the pair of first sections.

* * * * *